US007974838B1

(12) United States Patent
Lukin et al.

(10) Patent No.: US 7,974,838 B1
(45) Date of Patent: Jul. 5, 2011

(54) SYSTEM AND METHOD FOR PITCH ADJUSTING VOCALS

(75) Inventors: Alexey Lukin, Moscow (RU); Jeremy Todd, Cambridge, MA (US); Mark Ethier, Cambridge, MA (US)

(73) Assignee: iZotope, Inc., Cambridge, MA (US)

( * ) Notice: Subject to any disclaimer, the term of this patent is extended or adjusted under 35 U.S.C. 154(b) by 686 days.

(21) Appl. No.: 12/041,245

(22) Filed: Mar. 3, 2008

Related U.S. Application Data

(60) Provisional application No. 60/892,399, filed on Mar. 1, 2007.

(51) Int. Cl.
*G10L 11/04* (2006.01)
*G10L 11/00* (2006.01)

(52) U.S. Cl. ..... 704/207; 704/270

(58) Field of Classification Search ..... 704/207, 704/270

See application file for complete search history.

(56) References Cited

U.S. PATENT DOCUMENTS 5,428,708 A * 6/1995 Gibson et al. ..... 704/270
5,446,238 A 8/1995 Koyama et al.
5,686,684 A 11/1997 Nagata et al.
5,889,223 A * 3/1999 Matsumoto ..... 84/609
5,966,687 A 10/1999 Ojard
6,307,140 B1 10/2001 Iwamoto
6,336,092 B1 * 1/2002 Gibson et al. ..... 704/268
6,405,163 B1 * 6/2002 Laroche ..... 704/205
6,931,377 B1 8/2005 Seya
2005/0244019 A1 * 11/2005 Lallemand ..... 381/94.3

OTHER PUBLICATIONS

Jordi Bonada Sanjaume, "Audio Time-Scale Modification in the Context of Professional Audio Post-Production", Research Work for PhD Program Informatica i Comunicacio Digital, in the Graduate Division of the Universitat Pompeu Fabra, Barcelona, Fall 2002, pp. 1-78.

Alexey Lukin and Jeremy Todd, "Adaptive Time-Frequency Resolution for Analysis and Processing of Audio", Convention Paper presented at the 120th Convention, May 20-23, 2006, Paris, France, pp. 1-10.

* cited by examiner

*Primary Examiner* — Vincent P Harper
(74) *Attorney, Agent, or Firm* — David Lowry

(57) ABSTRACT

A system and method to assist a singer or other user. An audio source is processed to extract the lead vocals from the audio signal. This vocal signal is fed to a pitch detection processor which estimates the pitch at each moment in time. A user singing into a microphone provides a user vocal signal that is also pitch detected. The pitch of the lead vocal signal and the user vocal signal are compared and any difference is provided to a pitch shifting module, which then can correct the pitch of the user vocal signal. The corrected user vocal signal may be combined with a background signal comprising a signal from the audio source without the lead vocal signal, and then provided to headphones or loudspeakers to the user and/or an audience. This system and method may be used for Karaoke performances.

20 Claims, 2 Drawing Sheets

SYSTEM AND METHOD FOR PITCH ADJUSTING VOCALS

This application claims priority to provisional U.S. Application Ser. No. 60/892,399, filed Mar. 1, 2007, herein incorporated by reference.

FIELD OF THE INVENTION

The invention relates generally to audio processing. More specifically, the invention provides a system and method for analysis and adjustment of vocal qualities, potentially in real-time.

BACKGROUND OF THE INVENTION

Sing-along entertainment, such as Karaoke, is a popular pastime around the world. However, as any attendee of a Karaoke event can attest, a singer's enthusiasm may be far greater than their singing talent. One common shortcoming of amateur (and occasionally professional) singers is being off-key.

Even if a singer is only slightly off-key (or off-pitch), this can cause the performance to be much less enjoyable both for the singer and the audience. Any ability to help correct the singer's vocals would vastly improve the performance and the enjoyment of all parties. More people would be willing to participate if they knew they would not be embarrassed by their potentially off-key singing.

Another problem is that while a singer may be close enough in pitch through much of a song, certain notes may simply be beyond their range. Therefore a singer may greatly benefit from just a few "adjustments" to turn a mediocre performance into a great performance.

Another problem with Karaoke is the need to prepare materials in advance of the performance. Music which does not include the lead vocal must be prepared and provided to the singer. Many music industries prepare such vocal-free music, however a performance may be limited by the lack of recorded music without removed lead vocals.

BRIEF SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. The following summary merely presents some concepts of the invention in a simplified form as a prelude to the more detailed description provided below.

An embodiment of the present invention includes a system wherein an original piece of audio, called the source material, is fed into the system. The source material is processed to extract the lead vocals from the audio signal, resulting in a vocal signal which contains only the lead vocals, and a signal which contains only the rest of the music, called the background signal. The vocal signal is fed to a pitch detection processor which computes an estimate of pitch at each moment in time. The output of the pitch detection processor is called the desired pitch envelope. A user sings into a microphone forming the user vocal signal. The user vocal signal is fed to the pitch detection processor. The output of this pitch detection processor is called the user pitch envelope.

The system subtracts the user pitch envelope from the desired pitch envelope to form the corrective pitch envelope. This corrective pitch envelope is passed to a pitch shifting module, forming a corrected user vocal signal. The corrected user vocal signal may be added to the background signal to form the system's output. This output is typically fed to headphones or loudspeakers so that the user can hear it to guide the user's performance. Alternatively, the background signal may be pitch-adjusted to match the user vocal signal.

An embodiment of the present invention includes a method comprising receiving a first audio signal, extracting a vocal signal from the first audio signal, determining a pitch for the extracted vocal signal, receiving a second audio signal, determining a pitch for the second audio signal, and adjusting the pitch of the second audio signal based on a difference between the pitch of the vocal signal and the second audio signal. The process of extracting a vocal signal from the first audio signal may include producing a third audio signal, the third audio signal comprising the first audio signal without the vocal signal. This third audio signal may be combined with the adjusted second audio signal, and then played over a loudspeaker. Further processing may also be performed. The third audio signal may be delayed before combining the third audio signal with the adjusted second audio signal.

The first audio signal may be a stereo audio signal, and the process of extracting a vocal signal from the first audio signal includes determining a portion of the first audio signal that is present in both channels of the stereo first audio signal. An embodiment may attenuate similar coefficients present in both channels of the stereo first audio signal.

The second audio signal may be a vocal signal from a singer. The singer may be singing while the embodiment performs the processing. An embodiment may perform such processing is real time, as the singer is singing.

The process of determining a pitch includes determining a pitch value and a reliability value. Further, the process of determining a pitch for the extracted vocal signal includes limiting a pitch detection range based on the determined pitch of the second audio signal.

Another embodiment of the present invention includes an audio processing system comprising a vocal extraction component, to receive a first audio signal and produce a second audio signal comprising vocals present in the first audio signal; a first pitch detection component, to receive the second audio signal and produce a first pitch value indicating a pitch of the second audio signal. It may also include a pitch differencing component, to receive the first pitch value and a second pitch value, and to produce a pitch envelope indicating a difference in pitch between the first pitch value and the second pitch value; and a pitch shifting component, to receive the pitch envelope and a third audio signal, and produce a pitch-adjusted audio signal comprising the third audio signal with an adjusted pitch based on the pitch envelope. The second pitch value may indicate a pitch of the third audio signal. The first audio signal may be a stereo audio signal, and the vocal extraction component may determine a portion of the first audio signal that is present in both channels of the stereo audio signal. Further, the vocal extraction component may attenuate similar coefficients present in both channels of the stereo audio signal.

The vocal extraction component may produce a background audio signal comprising the first audio signal without the second audio signal. This background audio signal may be combined with the pitch-adjusted audio signal. The third audio signal may be from a singer singing, and the embodiment combines the background audio signal with the pitch-adjusted audio signal while the singer is singing.

An embodiment includes a computer-readable media including executable instructions, wherein, when said executable instructions are provided to a processor (including a general purpose processor, or a special purpose processor such as a DSP (digital signal processor)), cause the processor to perform a method comprising receiving a first audio signal, extracting a vocal signal from the first audio signal, and determining a pitch for the extracted vocal signal. The method may also include receiving a second audio signal, determining a pitch for the second audio signal, and adjusting the pitch of the second audio signal based on a difference between the pitch of the vocal signal and the second audio signal.

The computer-readable media may also include executable instructions to cause the processor to perform a method wherein the process of extracting a vocal signal from the first audio signal includes producing a third audio signal, the third audio signal comprising the first audio signal without the vocal signal; and combining the third audio signal with the adjusted second audio signal. The first audio signal may be a stereo audio signal, and the process of extracting a vocal signal from the first audio signal includes determining a portion of the first audio signal that is present in both channels of the stereo first audio signal; and attenuating similar coefficients present in both channels of the stereo first audio signal.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION OF THE INVENTION

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

Figure 1:
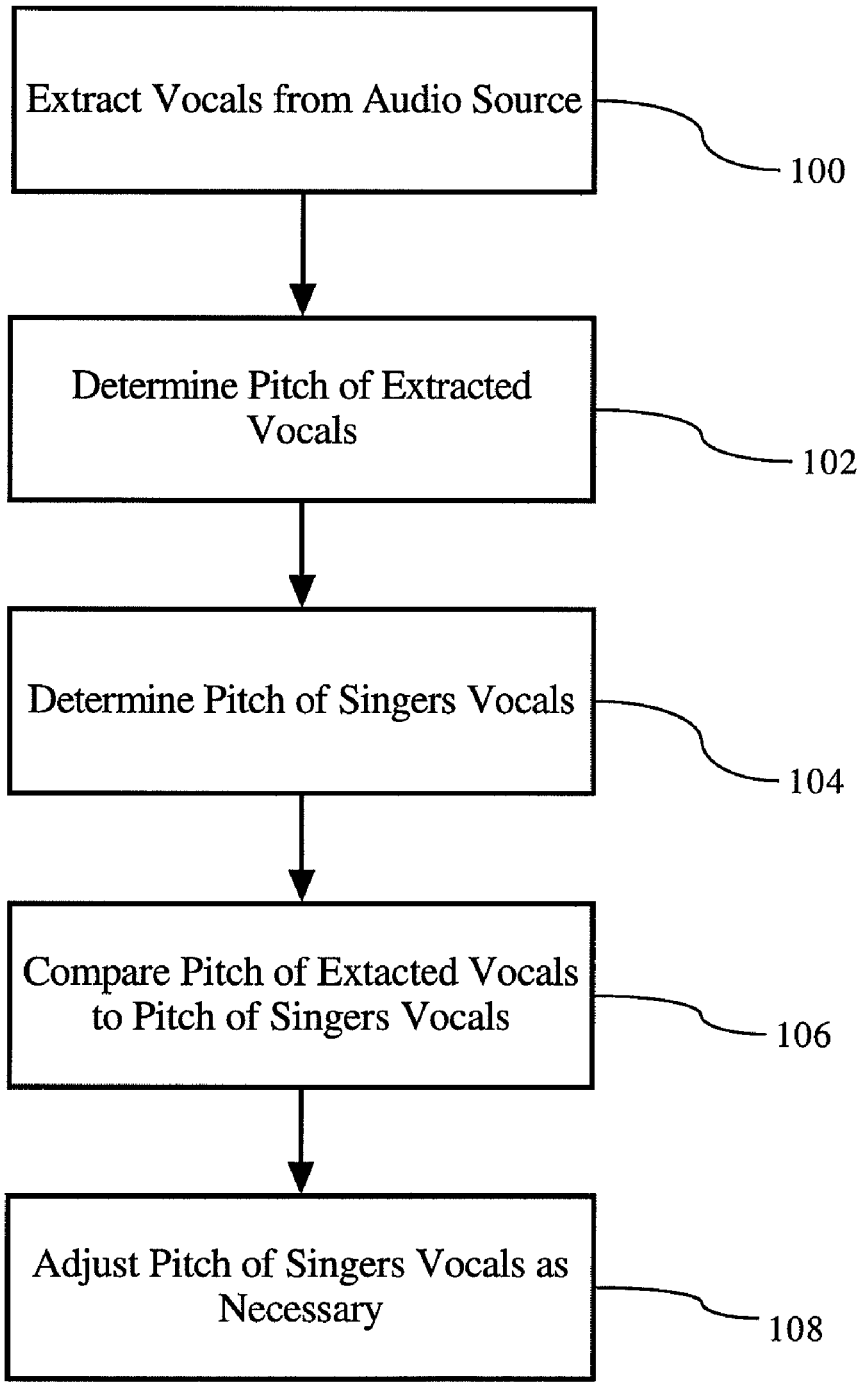
FIG. 1 illustrates a method according to an embodiment of the present invention.

The present invention comprises a system and method for adjusting a singer's vocals to match the pitch of an audio source. FIG. 1 provides an overview of steps performed by one embodiment of the present invention. As will be discussed below, this process may be performed in real-time on an audio stream and vocal input from a singer. At step 100, vocals are isolated and extracted from an audio source. In this embodiment, center channel extraction is utilized for isolating and removing lead vocals. In some source materials, lead vocals will not be panned to the center of the stereo field, and in these cases other vocal removal techniques may be used. Details of this process will be discussed below.

Once the lead vocals or other lead signal is extracted, the pitch of the extracted vocals is determined, step 102. Similarly, the pitch of a singer's vocals is determined, step 104. Since the pitch of both the extracted vocals and the singer's vocals is known, they may be compared, step 106. If the singer is singing at the correct pitch (or within an acceptable variation), then the singer's vocal signal may be passed along with no modification. However, if the singer is off-pitch, the singer's vocal signal may be pitch adjusted to bring it in conformance with the extracted vocal signal, step 108.

Figure 2:
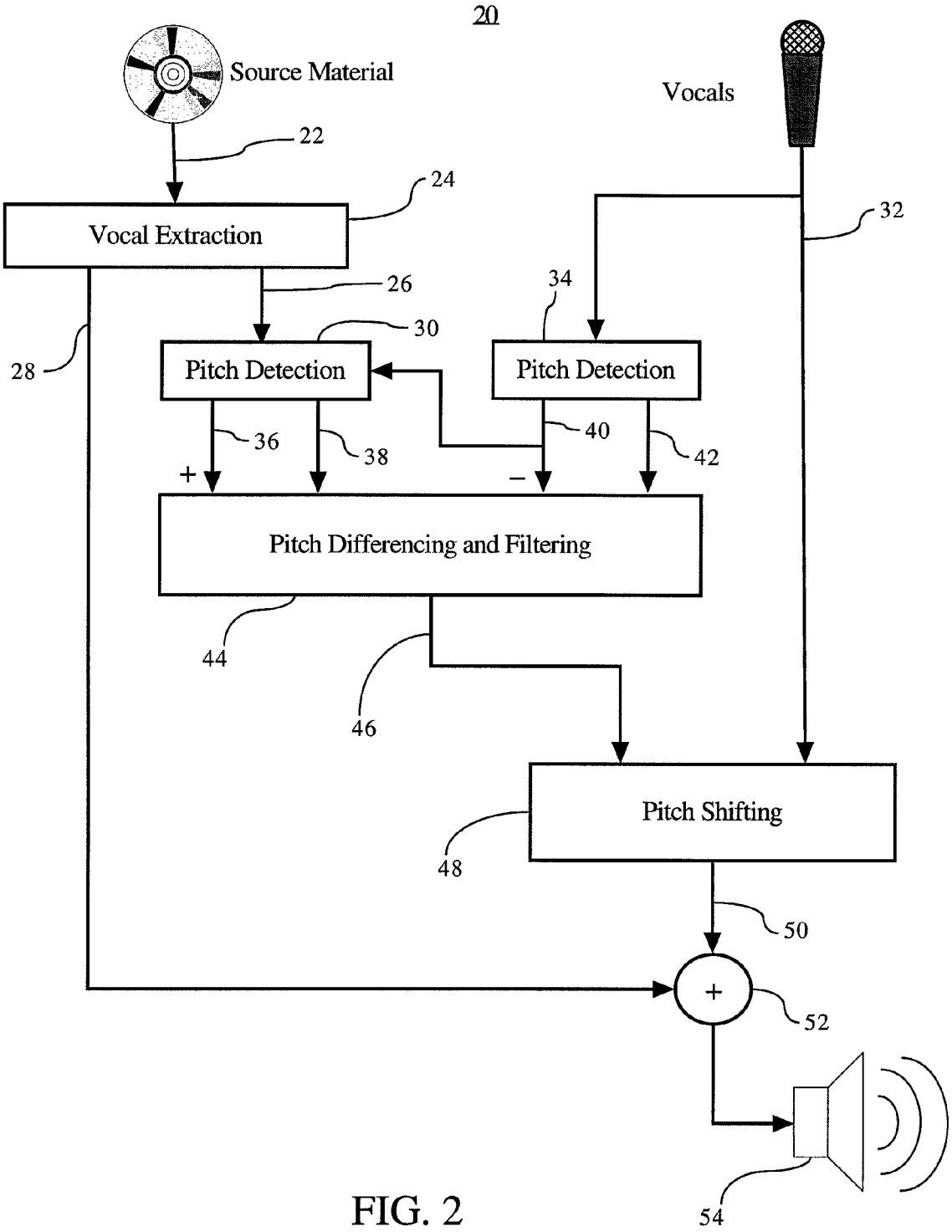
FIG. 2 illustrates a system according to one embodiment of the present invention.

FIG. 2 illustrates an embodiment 20 of the present invention capable of performing such pitch adjustment in real time. This embodiment may be used for live performances, for example Karaoke setups. For the realtime constraint, live singers should be able to hear the corrected singer vocal signal with minimal latency, typically values less than 50 milliseconds are acceptable. This means that all processing applied to the singer vocal signal should happen with minimal latency. As will be described below, while the embodiment is capable of performing all processing with minimal discernable delay, it is within the scope of the invention to perform some processing in advance. For example, the vocal extraction and pitch detection may be performed in advance, with the pitch information stored for later use during the singing performance. Alternatively, a latency may be used with the audio source to allow the required processing, such latency is not discernable by the singer or audience.

An audio source such as a CD or stored audio file, provides an audio signal 22. The vocals in the audio signal 22 are extracted, in this embodiment by a center channel extraction process 24. The center channel extraction algorithm separates the reference recording (source material) into musical background 28 and lead vocal 26. The simplest way of extraction of musical background from a stereo recording is known as stereo channels subtraction and works by subtracting a waveform of left stereo channel from a waveform of right stereo channel. The limitations of this simple algorithm are inherently monophonic output musical signal and lack of ability to separate lead vocal, which is required for pitch tracking.

The embodiment improves on this simple algorithm with the use of a time-frequency transformation, such as a Short-Time Fourier Transform (STFT). Since the center channel extraction algorithm works with a pre-recorded input waveform, it can have a considerable amount of latency (or look-ahead) to achieve best possible quality. The embodiment utilizes STFT with a 10 ms time window and a 1.25 ms time hop. The resulting complex-valued STFT coefficients for left and right stereo channels are denoted as $X_L[t,k]$ and $X_R[t,k]$, where t is a time frame index and k is a frequency bin index. The process of the center channel extraction algorithm is to attenuate coefficients that are similar in left and right channels. Such coefficients are likely to correspond to sound sources that are panned to the center of a stereo field.

A Relative difference of left/right coefficients is calculated as follows:

$$D[t,k] = \frac{|X_L[t,k] - X_R[t,k]|^2}{|X_L[t,k]|^2 + |X_R[t,k]|^2 + \varepsilon}$$

Here $\epsilon$ is a small constant to prevent division by zero. Then for this pair of coefficients a real-valued attenuation gain is calculated as follows:

$$G[t,k] = \min\{(1.5D[t,k])^{0.75S}, 1\}$$

Here S is a desired center channel attenuation strength typically varying between 0.5 and 2. The resulting gains are recursively smoothed in time by means of a $1^{st}$ order filter with asymmetrical rise/fall constants as follows:

$$\hat{G}[t,k] = \hat{G}[t-1,k] + \alpha\left(G[t,k] - \hat{G}[t-1,k]\right)$$

-continued $$\alpha = \begin{cases} \alpha_{up}, & G[t,k] > \hat{G}[t-1,k] \\ \alpha_{dn}, & \text{otherwise} \end{cases}$$

Here $\alpha_{up}$ and $\alpha_{dn}$ constants are selected to provide integration time of 20 and 10 ms accordingly.

When STFT coefficients are multiplied by time-smoothed gains, the inverse STFT is calculated to restore the background music 28 with attenuated center channel. To extract the center channel, the embodiment subtracts the separated background music from the source recording (or, alternatively, uses gains 1-G).

Should this algorithm include artifacts arising from a time-frequency transformation with a fixed window size, an adaptive multi-resolution processing technique may be utilized. This technique comprises processing source material with several different time-frequency resolutions and combining results in a transience-adaptive manner. This improves depth of center channel attenuation and at the same time reduces softening of transients.

To reduce the time smearing of transients, this embodiment may increase the temporal resolution of the filter bank at transient signal segments. During stationary segments, the embodiment uses higher frequency resolution. An algorithm is utilized which integrates signal energy in critical bands and detects fast energy onsets on a per-band basis. The signal is transformed into the STFT domain with a window size of 12 ms and an analysis hop of 6 ms. For each frame the signal power is integrated inside 24 critical bands covering the entire audible spectrum. The integrated energy is raised to the power of ⅛ to provide better sensitivity to relatively high energy onsets at small absolute levels. Then variation of energy in time are detected within each critical band by cross-correlating energies e[b, t] with a filter h[t]={−1, −1, −1, 0, 1, 1, 1} (here b is the critical band number, t is the index of the STFT frame):

$$v[b,t]=e[b,t]*h[-t]$$

The transience T[b,t] of the signal in each critical band is estimated as $$T[b,t] = \begin{cases} v[b,t], & v[b,t] \geq 0 \\ \dfrac{|v[b,t]|}{10}, & v[b,t] < 0 \end{cases}$$

This provides 10 times better sensitivity to energy onsets than to energy decays.

When the transience of a signal in each critical band is estimated, it can be used to control the time-frequency resolution of a filter bank by reducing frequency resolution around transients. This reduces the smearing of transients in time while keeping good frequency resolution at stationary parts of the signal.

One embodiment using this technique uses 3 STFT filter banks with window sizes of 24, 48, and 96 ms and combines their results using another STFT filter bank with a window size of 12 ms (it is help to have good time resolution when combining results, but the frequency resolution is not as important since all of the noise reduction processing has already been done). The transience detector also operates with a window size of 12 ms. The combination of results is performed according to the following formula:

$$X_{f,t} = \begin{cases} \alpha X_{f,t,2} + (1-\alpha)X_{f,t,3}, & f \leq 4000\,\text{Hz} \\ \alpha X_{f,t,1} + (1-\alpha)X_{f,t,2}, & f > 4000\,\text{Hz} \end{cases}$$

Here a depends on transience for a given bin of the STFT:

$$\alpha = \begin{cases} 0, & T[f,t] < T_1 \\ \dfrac{T[f,t]-T_1}{T_2-T_1}, & T_1 \leq T[f,t] < T_2 \\ 1, & T[f,t] \geq T_2 \end{cases}$$

Here $T_1$ and $T_2$ are user-defined thresholds, and for this embodiment they defined by $T_2=2T_1$.

Such a mixing strategy uses 2 times better frequency resolution below 4 kHz (approximating the property of better low-frequency resolution of our hearing) and adapts the resolution to the local transience of the signal inside each critical band.

If the source material contains musical content in the center of the stereo field in addition to the lead vocals, this musical content may show up as noise in the original vocal signal 26. This may affect the reliability of pitch detection 30 when computing the desired pitch envelope. In this case the reliability of pitch detection may be improved. Since the user vocal signal 32 contains only the user's vocals, pitch detection can be performed quite reliably on this signal. Also it is safe to assume that the singer is attempting to sing the same pitch as the lead vocals. Therefore an embodiment can guide the computation of the desired pitch envelope 46 by restricting it to a (possibly adjustable) range of several semitones above and below the user pitch envelope, as will be explained below.

Once extracted, the lead vocal signal 26 is provided to a pitch detector 30. Similarly, a pitch detector 34 performs processing of the singer's vocals 32. The pitch detector 30 determines a pitch value 36 of the lead vocals, and also a pitch detection reliability value 38. The pitch detection algorithm according to this embodiment uses autocorrelation functions to detect the pitch lag at regular time intervals in the audio signal (using pitch detection stride of 1.5 ms). The detection is performed within $l_{min}$ and $l_{max}$—minimal and maximal lag values corresponding to pitches of 150 to 400 Hz for male vocal performance and 200 to 500 Hz for female performance. This may be set by a user or by other techniques. The autocorrelation window size is selected as $3l_{max}$. The autocorrelation function is time-smoothed with a $1^{st}$ order recursive filter with integration time of 10 ms. A maximum of smoothed autocorrelation function A[l] at lag $l_m$ is considered as initial pitch estimate. If $2l_m<l_{max}$, a possible candidate $l_k$ for pitch lag one octave lower than the initial estimate is evaluated at lags from $2l_m-1$ to $2l_m+1$. If $3A[l_k]>2A[l_m]$ and the pitch lag detected for previous time frame is less than $3l_m/2$ then $l_k$ is selected as the initial pitch estimate $l_e$, otherwise $l_e=l_m$.

The initial pitch lag estimate is refined using the non-smoothed autocorrelation function by searching for a maximum within a range of $0.8l_e$ to $1.2l_e$, which is denoted $l_r$.

In each time frame, pitch detection reliability 38 is calculated as follows:

$$R = \frac{A[l_r]}{\left(\frac{1}{N}\sum_{l=0}^{N-1} A[l]^2\right)^{\frac{1}{2}}}$$

It is used by pitch filtering system 44 to reduce artifacts from erroneous pitch estimates.

Finally, the rate of pitch variations is limited in time to produce the final pitch estimate $36l_c$:

$$l_c = \max\left\{\frac{\hat{l}_c}{V},\ \min\{\hat{l}_c V, l_r\}\right\}$$

$$V = \exp(5 + 6RT)$$

Here T is the time hop (in seconds) of pitch detection, and $\hat{l}_c$ is the previous estimate of constrained pitch.

A similar pitch detection process 34 is performed on the singer's vocals 32. In this embodiment, the first step in the overall algorithm is pitch detection for the singer's vocal signal 32. Then the pitch detection 30 of the extracted vocal signal 26 is performed. Since the extracted vocal signal may contain residuals of a music signal due to imperfections of a central channel extraction, ordinary pitch detection algorithms may fail to operate correctly for such polyphonic signal. To facilitate pitch detection, the embodiment sets $l_{min}$ and $l_{max}$ constants to cover the range within +/−1 semitone (6% of frequency change) from the detected singer vocal pitch 40, with the presumption that the signer is singing close to the original vocal pitch. This range may be user-adjusted, possibly dynamically, as necessary. Such a constraint on a pitch search range allows the embodiment to abstract from interfering musical residual in the extracted center channel and only search for vocal pitch, assuming that it's close to the singer's pitch. Typically this improves the reliability of the pitch detection algorithm and make it only react to voice in an extracted center channel, as opposed to reacting to instruments. Since central channel extraction typically cannot extract just the human vocals, it is helpful to provide assistance to the pitch detection process with a hint of the probable pitch position based on the singer's pitch. Even if the singer is far off-pitch, the embodiment can still reliably track the vocal pitch from the audio source.

The extracted vocal pitch detection value 36 and reliability value 38, and the singer's pitch detection value 40 and reliability value 42, are then provided to a pitch differencing and filtering processor 44. The difference of detected original and user vocal pitches 36, 40 forms a correction pitch envelope x[t], labeled as 46. To reduce spurious and erroneous samples from the pitch envelope, it is filtered in a non-linear manner to give more weight to reliably estimate samples in a filtered corrective pitch envelope x̂[t]:

$$\hat{x}[t] = \frac{\sum_{i=-20}^{20} w[t+i]x[t+i]}{\sum_{i=-20}^{20} w[t+i]}$$

-continued $$w[t] = \frac{1}{\sqrt{R_{orig}[t]R_{user}[t]} + 0.1}$$

Here $R_{orig}[t]$ and $R_{user}[t]$ are pitch detection reliabilities 38, 42 for the original and singer vocal signals.

The resulting pitch correction envelope x[t] is the amount of pitch shifting to be applied to the singer's voice in order to match its pitch with the extracted voice.

The next step according to this embodiment is pitch shifting 48 of the singer's vocal signal 32 based on the pitch envelope 46. For pitch shifting, a PSOLA-type (Pitch-synchronous Overlap and Add) algorithm is used, similar to the one described in Bonada, J. "Audio Time-Scale Modification in the Context of Professional Post-Production" Research work for PhD program, Univeristat Pompeu Fabra, Barcelona, 2002, which in incorporated herein by reference. The original PSOLA algorithm has been developed for time scale modifications of audio signals without pitch modification. For the embodiment of the present invention, the PSOLA algorithm is combined with sampling rate conversion (resampling) to achieve pitch shifting, as known in the prior art. For example, to achieve pitch shifting by the factor of x[t], the embodiment applies a PSOLA time stretching by the factor x[t], and then resamples the resulting signal to the original duration (i.e. by 1/x[t] times). The resampling operation synchronously changes pitch and duration of the signal, which produces the desired pitch shifting effect.

The PSOLA algorithm for time scale modification breaks the signal into windowed time granules with 2-times overlap. Division of the signal into granules is guided by pitch detection: each granule has the length of 2 pitch periods. Then, in order to achieve time stretching by a fractional factor k, 1<k<2, every (k−1)N granules out of N are duplicated in the output signal according to their pitch period. For example, to stretch the signal by a factor of 1.33, every third granule of the input signal is duplicated in the output signal. Conversely, in order to achieve time compression, certain granules of the input signal are discarded from the output signal. More details of this algorithm are given in the Bonada reference.

For resampling, a polyphase FIR filtering approach may be used, as is known in the prior art. This reverts the signal to its original time duration, but now at the desired pitch.

Once the singer's vocal signal has been pitch adjusted, the pitch adjusted signal 50 may be combined 52 with the background music signal 28, and then played out 54, or recorded. The gain, EQ and panning the pitch adjusted signal 50 and the background signal 28 may be adjusted as desired. Alternatively, the background music signal 28 and pitch adjusted signal 50 may be played through separate loudspeakers (not shown). A singer may be provided with headphones or separate monitor speaker to hear their vocals unadjusted, to avoid confusion over their altered vocals. The background music signal 28 may be combined with the unadjusted singer vocals and provided to the singer.

Although this invention has been described in terms of Karaoke systems, the present invention can be used in many different systems and situations. The present invention may also be used to adjust a live or pre-recorded instrument that is out of tune compared to other instruments making up the music. Another embodiment of the present invention may determine a pitch of the singers vocals, and then create a harmony by pitch adjusting the vocal signals by a certain range (a fourth, fifth, or octave up or down, etc.) and mixing it with the original vocal signal. Another embodiment may work with multiple singers, wherein the system may adjust several singers vocals simultaneously, or work with a combined vocal signal (possibly from a shared microphone) and make adjustments and corrections as possible.

The present invention can be implemented in software running on a general purpose CPU, or special purpose processing machine (including DSPs), or in firmware or hardware. An embodiment of the present invention may include a stand-alone unit used for playing music, or integrated into a system or deck for providing PA music in facilities and at events. Another embodiment may include a plug-in module for a digital audio workstation, or mixing console. The processes and algorithms used by embodiment of the present invention may be performed in separate steps and separate times, and may be performed in any order. The inventive method systems and methods may be embodied as computer readable instructions stored on a computer readable medium such as a floppy disk, CD-ROM, removable storage device, hard disk, system memory, flash memory, or other data storage medium. When one or more computer processors execute one or more of the software modules, the software modules interact to cause one or more computer systems to perform according to the teachings of the present invention.

Although the invention has been shown and described with respect to illustrative embodiments thereof, various other changes, omissions, and additions in the form and detail thereof may be made therein without departing from the spirit and scope of the invention. Therefore, the scope of the invention is not meant be limited except as defined by the claims.

We claim:

1. A method performed by a processor, comprising:

receiving a first audio signal;

extracting a vocal signal from the first audio signal;

receiving a second audio signal;

determining a pitch for the second audio signal;

determining a pitch for the extracted vocal signal by limiting a pitch detection range based on the determined pitch of the second audio signal; and adjusting the pitch of the second audio signal based on a difference between the determined pitch of the extracted vocal signal and the second audio signal.

2. The method of claim 1 wherein the process of extracting a vocal signal from the first audio signal includes producing a third audio signal, the third audio signal comprising the first audio signal without the vocal signal.

3. The method of claim 2 further including combining the third audio signal with the adjusted second audio signal.

4. The method of claim 3, further including delaying the third audio signal before combining the third audio signal with the adjusted second audio signal.

5. The method of claim 1 wherein the first audio signal is a stereo audio signal, and the process of extracting a vocal signal from the first audio signal includes determining a portion of the first audio signal that is present in both channels of the stereo first audio signal.

6. The method of claim 5 wherein the process of extracting a vocal signal from the first audio signal includes attenuating similar coefficients present in both channels of the stereo first audio signal.

7. The method of claim 1 wherein the second audio signal is a vocal signal from a singer.

8. The method of claim 1 wherein determining a pitch includes determining a pitch value and a reliability value.

9. The method of claim 7 wherein the method is performed as the singer is singing.

10. The method of claim 1 wherein the pitch detection range is limited to within +/− one semitone of the determined pitch of the second audio signal.

11. The method of claim 1 wherein the pitch detection range is dynamically adjusted.

12. An audio processing system comprising:

a vocal extraction component, to receive a first audio signal and produce a second audio signal comprising vocals present in the first audio signal;

a first pitch detection component, to receive the second audio signal and produce a first pitch value indicating a pitch of the second audio signal, wherein the first pitch detection component limits a pitch detection range for the second audio signal based on a detected second pitch value of a third audio signal;

a pitch differencing component, to receive the first pitch value and the second pitch value, and to produce a pitch envelope indicating a difference in pitch between the first pitch value and the second pitch value; and a pitch shifting component, to receive the pitch envelope and the third audio signal, and produce a pitch-adjusted audio signal comprising the third audio signal with an adjusted pitch based on the pitch envelope.

13. The system of claim 12, wherein the first audio signal is a stereo audio signal, and the vocal extraction component determines a portion of the first audio signal that is present in both channels of the stereo audio signal.

14. The system of claim 13 wherein the vocal extraction component attenuates similar coefficients present in both channels of the stereo audio signal.

15. The system of claim 12 wherein the vocal extraction component produces a background audio signal comprising the first audio signal without the second audio signal.

16. The system of claim 15 wherein the background audio signal is combined with the pitch-adjusted audio signal.

17. The system of claim 16 wherein the third audio signal is from a singer singing, and the system combines the background audio signal with the pitch-adjusted audio signal while the singer is singing.

18. A computer-readable non-transitory media including executable instructions, wherein when said executable instructions are provided to a processor, cause the processor to perform a method, comprising:

receiving a first audio signal;

extracting a vocal signal from the first audio signal;

receiving a second audio signal;

determining a pitch for the second audio signal;

determining a pitch for the extracted vocal signal by limiting a pitch detection range based on the determined pitch of the second audio signal; and adjusting the pitch of the second audio signal based on a difference between the determined pitch of the extracted vocal signal and the second audio signal.

19. The computer-readable non-transitory media of claim 18, further including executable instructions to cause the processor to perform a method wherein the process of extracting a vocal signal from the first audio signal includes producing a third audio signal, the third audio signal comprising the first audio signal without the vocal signal; and combining the third audio signal with the adjusted second audio signal.

20. The computer-readable non-transitory media of claim 18, further including executable instructions to cause the processor to perform a method wherein the first audio signal is a stereo audio signal, and the process of extracting a vocal signal from the first audio signal includes determining a portion of the first audio signal that is present in both channels of the stereo first audio signal; and attenuating similar coefficients present in both channels of the stereo first audio signal.

* * * * *